US012162714B2

(12) United States Patent
Okutsu et al.

(10) Patent No.: US 12,162,714 B2
(45) Date of Patent: Dec. 10, 2024

(54) SHEET FEEDER AND IMAGE FORMING APPARATUS

(71) Applicants: Toshihiro Okutsu, Kanagawa (JP); Junya Suzuki, Kanagawa (JP)

(72) Inventors: Toshihiro Okutsu, Kanagawa (JP); Junya Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 143 days.

(21) Appl. No.: 17/977,334

(22) Filed: Oct. 31, 2022

(65) Prior Publication Data

US 2023/0202784 A1 Jun. 29, 2023

(30) Foreign Application Priority Data

Dec. 24, 2021 (JP) ..... 2021-210900

(51) Int. Cl.

| | |
|---|---|
| ***B65H 5/22*** | (2006.01) |
| ***B65H 3/06*** | (2006.01) |
| ***B65H 3/08*** | (2006.01) |
| ***B65H 5/06*** | (2006.01) |

(52) U.S. Cl.

CPC ..... *B65H 5/062* (2013.01); *B65H 3/06* (2013.01); *B65H 3/08* (2013.01); *B65H 2404/1431* (2013.01); *B65H 2404/165* (2013.01)

(58) Field of Classification Search

CPC ..... B65H 5/22; B65H 5/228; B65H 5/062; B65H 3/06; B65H 3/08; B65H 3/14; B65H 3/48; B65H 2404/1431; B65H 2404/165; B65H 2301/4461; B65H 29/24; B65H 29/245

See application file for complete search history.

(56) References Cited

U.S. PATENT DOCUMENTS

| | | | | |
|---|---|---|---|---|
| 5,645,274 | A * | 7/1997 | Ubayashi | B65H 3/128 271/265.04 |
| 7,007,944 | B1 * | 3/2006 | Dobbertin | B65H 3/128 271/98 |
| 8,167,298 | B2 * | 5/2012 | Ueda | B65H 3/128 271/98 |
| 8,336,879 | B2 * | 12/2012 | Suzuki | B65H 9/002 271/97 |
| 9,926,151 | B2 * | 3/2018 | Takahashi | B65H 3/047 |
| 2011/0157286 | A1 * | 6/2011 | Ikegami | B41J 11/0015 347/104 |
| 2013/0087967 | A1 | 4/2013 | Fuda et al. | |
| 2013/0106045 | A1 | 5/2013 | Okutsu et al. | |

(Continued)

FOREIGN PATENT DOCUMENTS

| | | |
|---|---|---|
| JP | 6-199438 | 7/1994 |
| JP | 2004-018159 | 1/2004 |

(Continued)

*Primary Examiner* — Leslie A Nicholson, III

(74) *Attorney, Agent, or Firm* — Harness, Dickey & Pierce, P.L.C.

(57) ABSTRACT

A sheet feeder includes a separator to separate an uppermost layer from a bundle of sheets stacked on a sheet stacker, a conveyor to convey a sheet of the uppermost layer one by one along a sheet conveyance path, and a first air blowing port and a second air blowing port disposed along the sheet conveyance path, to blow air upstream in a sheet conveyance direction. The second air blowing port is disposed downstream from the first air blowing port.

5 Claims, 10 Drawing Sheets

(56) References Cited

U.S. PATENT DOCUMENTS

| | | | |
|---|---|---|---|
| 2015/0166280 | A1 | 6/2015 | Hino et al. |
| 2016/0016740 | A1 | 1/2016 | Niikura et al. |
| 2016/0107853 | A1 | 4/2016 | Hashimoto et al. |
| 2016/0107854 | A1 | 4/2016 | Hashimoto et al. |
| 2016/0122144 | A1 | 5/2016 | Fukumoto et al. |
| 2016/0264370 | A1 | 9/2016 | Okutsu et al. |
| 2017/0081140 | A1 | 3/2017 | Fukumoto et al. |
| 2018/0237239 | A1 | 8/2018 | Okutsu et al. |

FOREIGN PATENT DOCUMENTS

| | | |
|---|---|---|
| JP | 2006-327716 | 12/2006 |
| JP | 2013-234049 | 11/2013 |

* cited by examiner

FIG. 3A-A
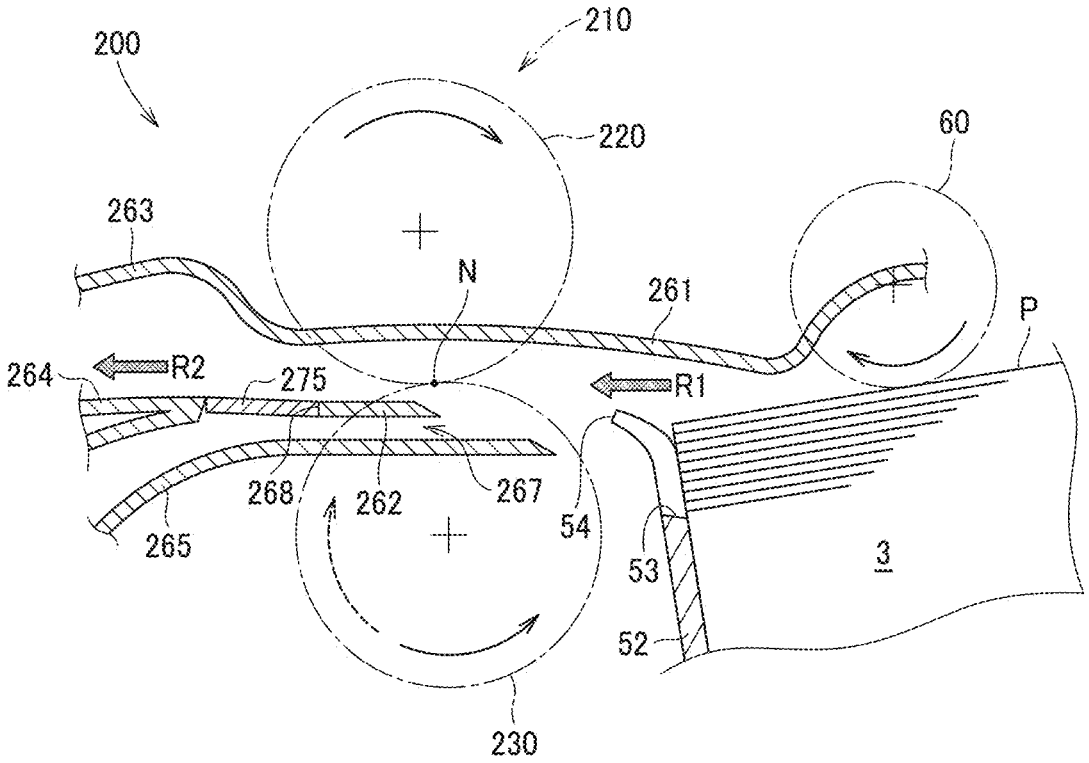
FIG. 3A-B
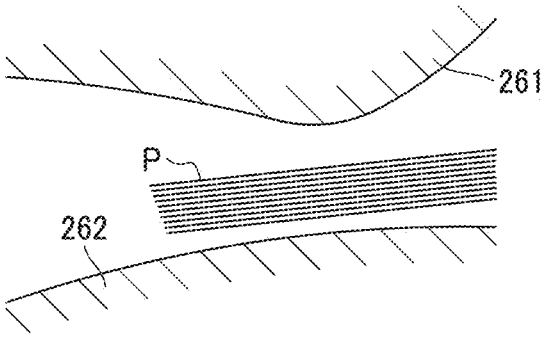

FIG. 3B-A
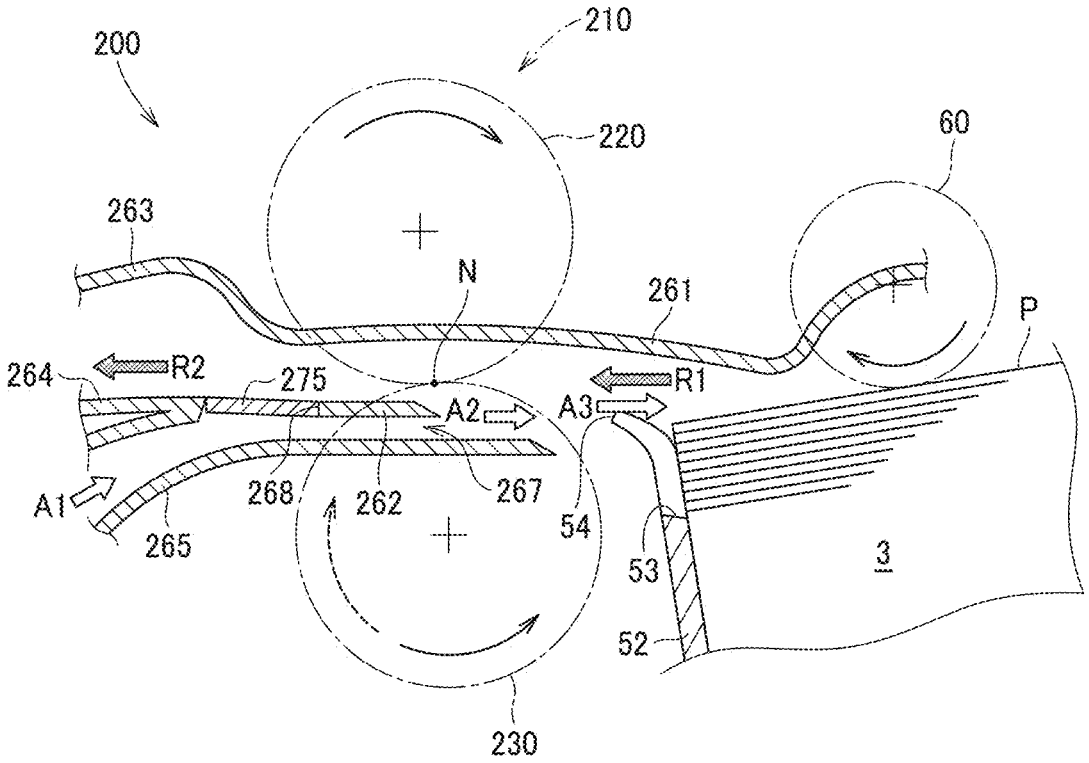
FIG. 3B-B
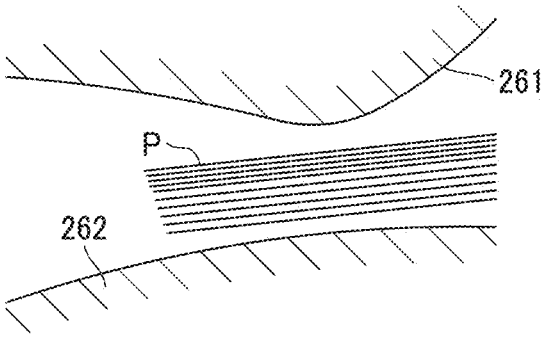

FIG. 3C-A
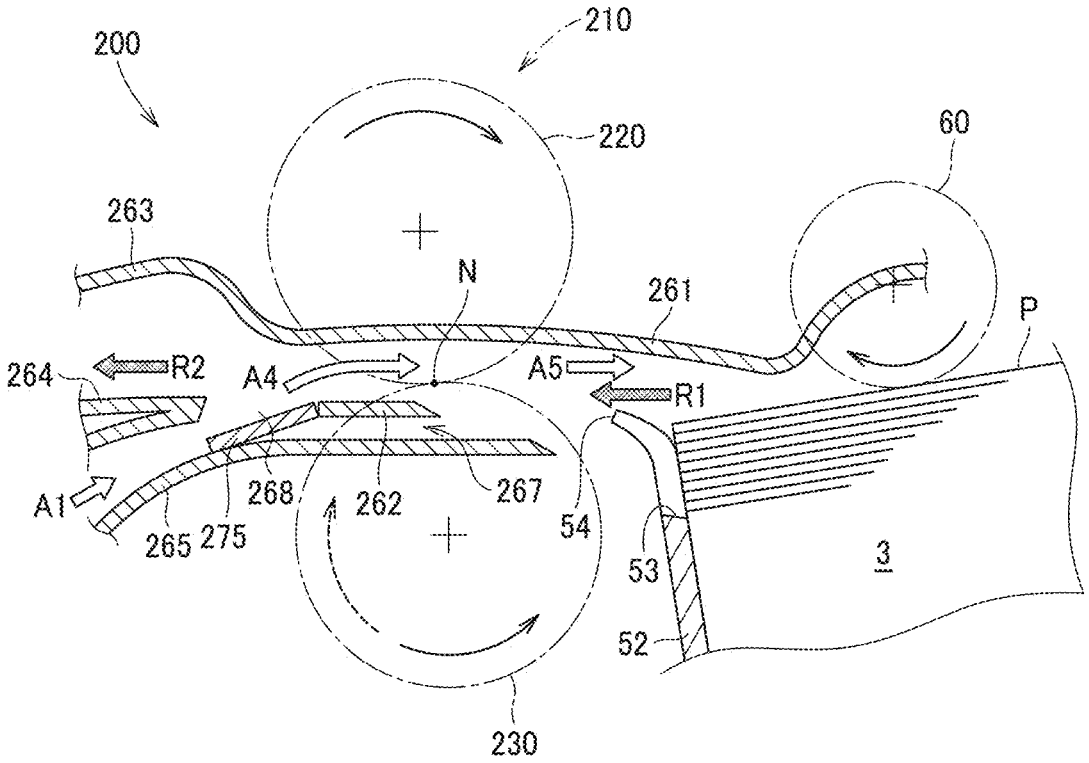
FIG. 3C-B
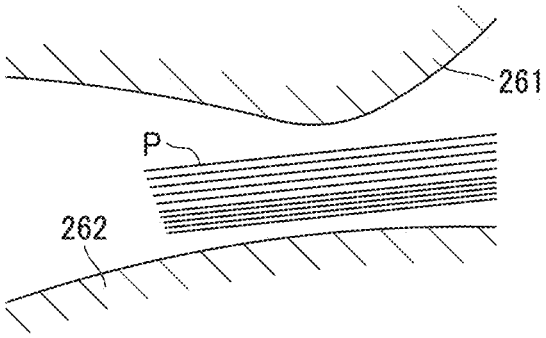

FIG. 3D-A
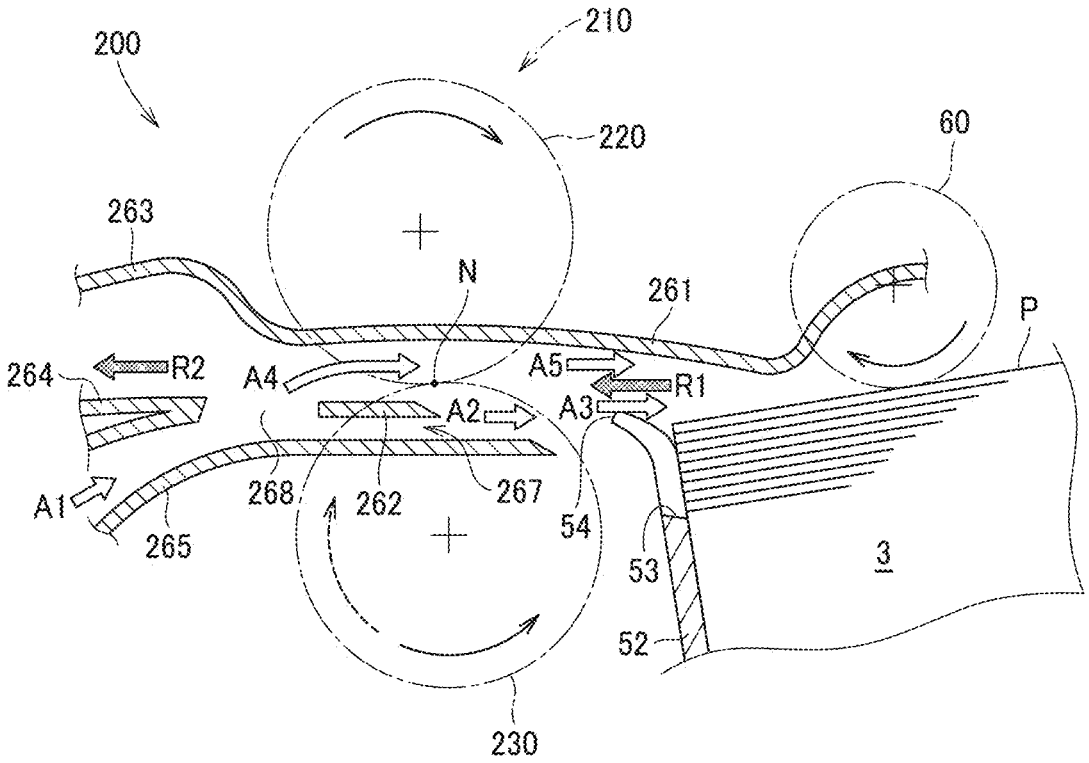
FIG. 3D-B
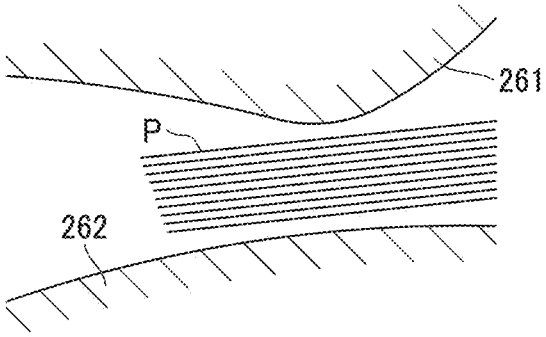

SHEET FEEDER AND IMAGE FORMING APPARATUS

CROSS-REFERENCE TO RELATED APPLICATIONS

This patent application is based on and claims priority pursuant to 35 U.S.C. § 119 (a) to Japanese Patent Application No. 2021-210900, filed on Dec. 24, 2021, in the Japan Patent Office, the entire disclosure of which is hereby incorporated by reference herein.

BACKGROUND

Technical Field

The present disclosure relates to a sheet feeder and an image forming apparatus including the sheet feeder.

Related Art

A sheet feeder used in an image forming apparatus conveys sheets stacked on a sheet feeding tray one by one from the top to a sheet conveyance path. For example, a known sheet feeder blows air to an upper layer of a bundle of sheets to separate the sheets in order to prevent a plurality of sheets from being conveyed in an overlapped state (multifeed) when conveying the sheets to the sheet conveyance path.

SUMMARY

In one aspect, a sheet feeder includes a separator to separate an uppermost layer from a bundle of sheets stacked on a sheet stacker, a conveyor to convey a sheet of the uppermost layer one by one along a sheet conveyance path, and a first air blowing port and a second air blowing port disposed along the sheet conveyance path, to blow air upstream in a sheet conveyance direction. The second air blowing port is disposed downstream from the first air blowing port.

In another aspect, an image forming apparatus includes the sheet feeder described above and an image forming device to form an image on the sheet conveyed by the sheet feeder.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein:

FIG. 3A-A is a cross-sectional view of the sheet feeder illustrated in FIGS. 2A to 2D in an initial state in which no air is blown out;

FIG. 3A-B illustrates an end of an uppermost layer of sheets fed to a sheet feeding path in FIG. 3A-A;

FIG. 3B-A is a cross-sectional view of the sheet feeder illustrated in FIGS. 2A to 2D in a state in which first air blowing ports are open and the second air blowing ports are closed;

FIG. 3B-B illustrates an end of an uppermost layer of sheets fed to the sheet feeding path in FIG. 3B-A;

FIG. 3C-A is a cross-sectional view of the sheet feeder illustrated in FIGS. 2A to 2D in a state in which the first air blowing ports are closed and the second air blowing ports are open;

FIG. 3C-B illustrates an end of an uppermost layer of sheets fed to the sheet feeding path in FIG. 3C-A;

FIG. 3D-A is a cross-sectional view of the sheet feeder illustrated in FIGS. 2A to 2D in a state in which both the first and second air blowing ports are open;

FIG. 3D-B illustrates an end of an uppermost layer of sheets fed to the sheet feeding path in FIG. 3D-A;

Figure 1A:
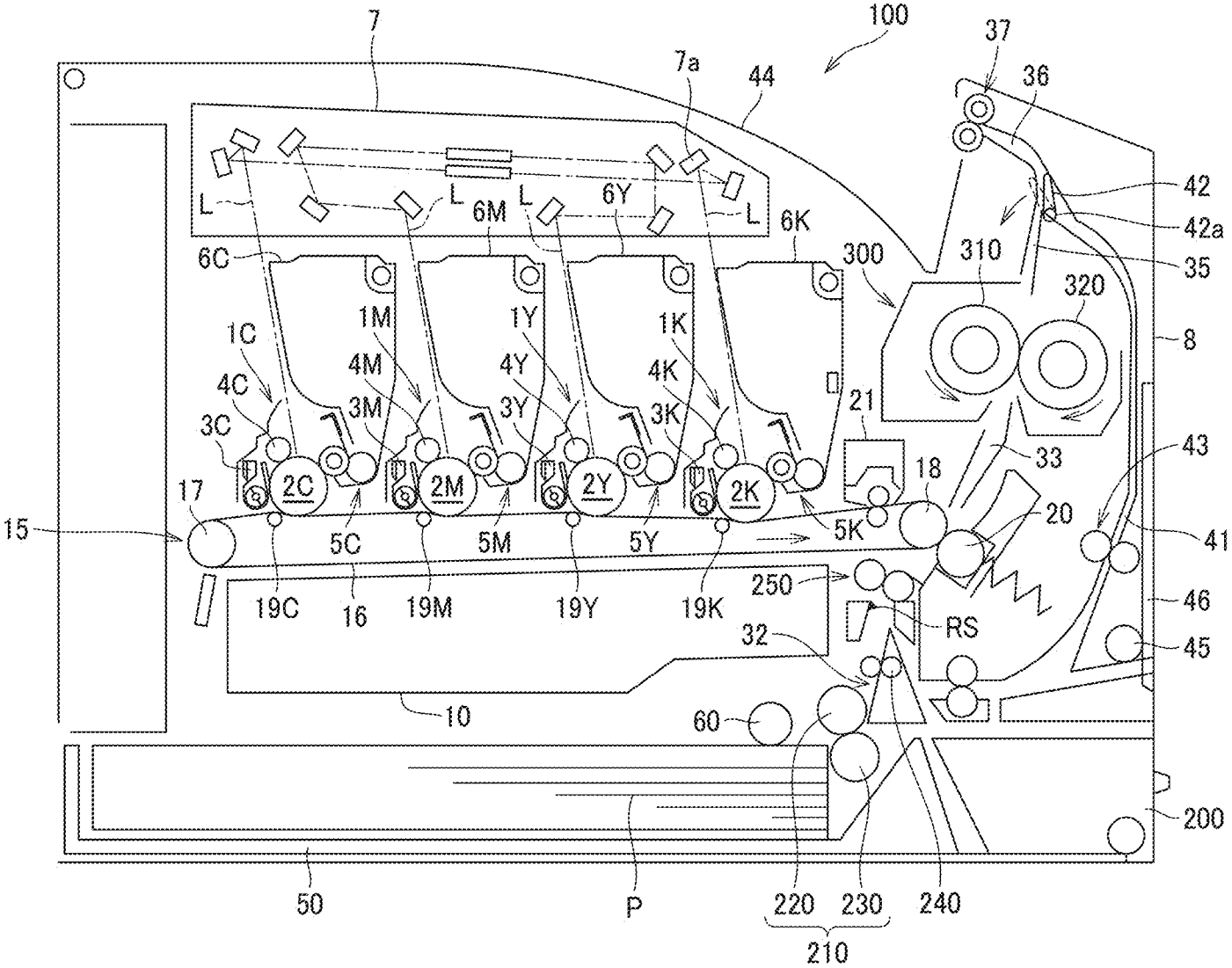
FIG. 1A is a schematic diagram illustrating a configuration of an image forming apparatus according to one embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

With reference to drawings, a description is given of a sheet feeder according to an embodiment of the present disclosure, and an image forming apparatus employing the sheet feeder. The image forming apparatus in the description below is a laser printer. The term "heating device" in the present disclosure represents a device that heats a sheet medium with a heating element. The term "fixing device" represents a device that conveys the sheet in a direction orthogonal to the longitudinal direction to a nip between the heating device and a pressure member and fixes unfixed toner applied to the sheet onto the sheet. The term "image forming apparatus" represents an apparatus that includes the fixing device and applies developer or ink to a sheet to form an image on the sheet. The sheet is an example of a recording medium on which an image is recorded.

The laser printer is an example of the image forming apparatus, and the image forming apparatus is not limited to the laser printer. In other words, the image forming apparatus may be a copier, a facsimile machine, a printer, a plotter, an inkjet recording apparatus, or a multifunction peripheral having at least two of copying, printing, facsimile transmission, plotting, scanning, and inkjet recording capabilities.

Note that identical or similar reference characters are given to identical or corresponding parts throughout drawings, and redundant descriptions are omitted or simplified. In this specification, the dimensions, material, shape, and relative positions of components are examples. Unless otherwise specified, the scope of the present disclosure is not limited thereto.

In the description below, a "recording medium" is a paper sheet, but a "recording medium" conveyed by the sheet feeder according to embodiments of the present disclosure is not limited to a paper sheet. Examples of the "recording medium" include, in addition to a paper sheet, an overhead projector (OHP) transparency, a fabric, a metallic sheet, a plastic film, and a prepreg sheet including carbon fibers preliminarily impregnated with resin.

Examples of the "recording medium" include any medium to which developer or ink can adhere, so-called recording paper, and a so-called recording sheet. Examples of the "sheet" include thick paper, a postcard, an envelope, thin paper, coated paper (e.g., art paper), and tracing paper, in addition to plain paper.

The term "image forming" used in the following description represents giving a medium not only an image having a meaning, such as a character or a graphic but also a meaningless image such as a pattern.

Configuration of Laser Printer

Figure 1B:
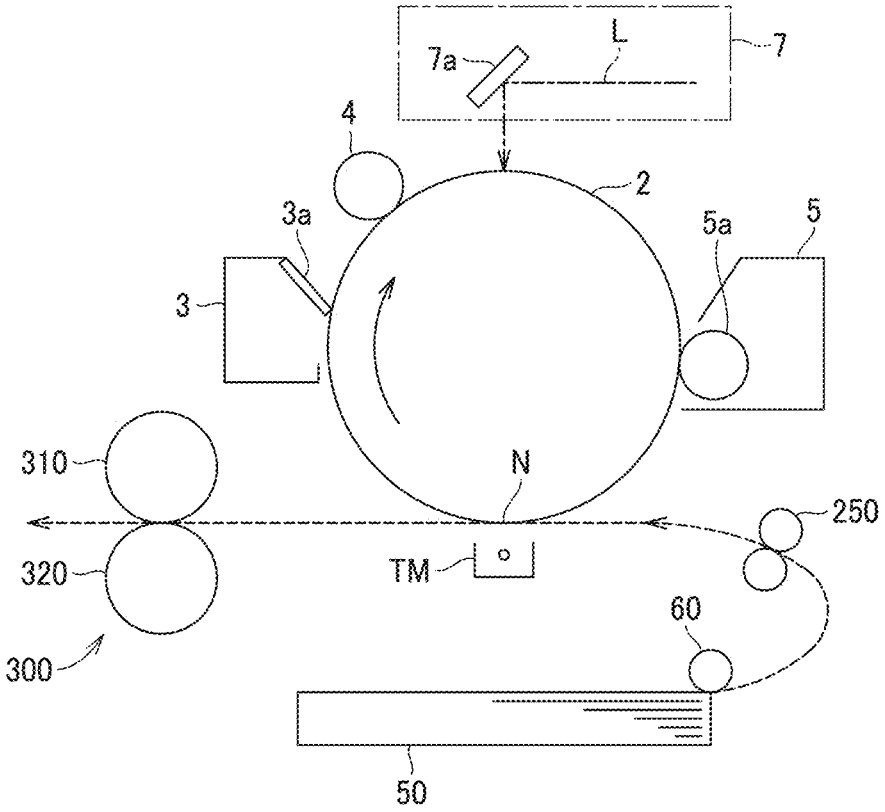
FIG. 1B is a schematic diagram illustrating the principle of operation of the image forming apparatus according to one embodiment of the present disclosure.

FIG. 1A is a schematic diagram illustrating a configuration of an image forming apparatus 100 provided with a sheet feeder 200 according to an embodiment of the present disclosure. The image forming apparatus 100 in the present embodiment is a laser printer. FIG. 1B illustrates the principle of an operation in the laser printer (as the image forming apparatus according to the present embodiment).

The image forming apparatus 100 includes four process units 1K, 1Y, 1M, and 1C as image forming devices. Suffixes K, Y, M, and C represent black, yellow, magenta, and cyan, respectively. The process units 1K, 1Y, 1M, and 1C form images with developer (toner) of black (K), yellow (Y), magenta (M), and cyan (C) that correspond to color components separated from full-color images.

The process units 1K, 1Y, 1M, and 1C (hereinafter collectively "process units 1") respectively include toner bottles 6K, 6Y, 6M, and 6C containing different color toners. The process units 1 have a similar structure except the color of toner. The process unit 1K is described as a representative, and the descriptions of other process units 1 are omitted.

The process unit 1K includes an image bearer 2K such as a photoconductor drum, a photoconductor cleaner 3K, and a discharger. The process unit 1K further includes a charging device 4K as a charger that uniformly charges the surface of the image bearer 2K and a developing device 5K that renders visible an electrostatic latent image formed on the image bearer 2K. Similarly, the process units 1Y, 1M, and 1C include image bearer 2Y, 2M, and 2C, photoconductor cleaner 3Y, 3M, and 3C, charging device 4Y, 4M, and 4C, and developing device 5Y, 5M, and 5C, respectively. The process unit 1K is detachably attachable to a body of the image forming apparatus 100. Consumable parts of the process unit 1K can be replaced at one time.

The image forming apparatus 100 further includes an exposure device 7 disposed above the process units 1K, 1Y, 1M, and 1C. The exposure device 7 performs scanning for writing based on image data, in other words, irradiates the image bearer 2K with laser light L emitted by a laser diode and reflected by mirrors 7*a* based on the image data.

In the present embodiment, a transfer device 15 is disposed beneath the process units 1K, 1Y, 1M, and 1C. The transfer device 15 corresponds to a transfer unit TM in FIG. 1B. Primary transfer rollers 19K, 19Y, 19M, and 19C are disposed opposite the image bearers 2K, 2Y, 2M, and 2C, respectively, in contact with an intermediate transfer belt 16.

The intermediate transfer belt 16 is stretched around and entrained by the primary transfer rollers 19K, 19Y, 19M, and 19C, a drive roller 18, and a driven roller 17 to rotate in a circulating manner. A secondary transfer roller 20 is disposed opposite the drive roller 18 and in contact with the intermediate transfer belt 16. Assuming that the image bearers 2K, 2Y, 2M, and 2C serve as a plurality of first image bearers for respective colors, the intermediate transfer belt 16 serves as a second image bearer on which the different color images are superimposed on top of one another.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

The sheet feeder 200 including a sheet feeding tray 50 (a sheet stacker) on which sheets P are stacked is installed below the image forming apparatus 100. The sheet feeder 200 is for supplying recording media (sheets P) and accommodates a large number of sheets P in a bundle form in the sheet feeding tray 50. The sheet feeder 200 is unitized together with a pickup roller 60 (a separator) and a feeding roller pair 210 that together serve as a conveyor to convey, one by one, an uppermost layer of a bundle of sheets P along a sheet conveyance path.

The sheet feeder 200 can be inserted into and removed from the body of the image forming apparatus 100 so that a user can put sheets in the sheet feeder 200. The pickup roller 60 and the feeding roller pair 210 (examples of a sheet feeding roller pair) are disposed at an upper portion of the sheet feeder 200 and convey the sheet P on the top in the sheet feeder 200 to a sheet feeding path 32.

Registration Roller Pair

A registration roller pair 250 separates and conveys the sheets P. The registration roller pair 250 is disposed adjacent to and upstream from the secondary transfer roller 20 in the direction in which the sheet P is conveyed (sheet conveyance direction) and temporarily stops the sheet P fed from the sheet feeder 200.

Temporarily stopping the sheet P causes slack at the leading end of the sheet P and corrects a skew of the sheet P.

A registration sensor RS is disposed adjacent to and upstream from the registration roller pair 250 in the sheet conveyance direction and detects passage of the leading end of the sheet P. When a predetermined time passes after the registration sensor RS detects the passage of the leading end of the sheet P, the sheet P contacts the registration roller pair 250 and temporarily stops.

At a downstream end of the sheet feeder 200 in the sheet conveyance direction, a conveyance roller pair 240 is disposed. The conveyance roller pair 240 conveys the sheet P, which is conveyed to the right from the feeding roller pair 210, upward. As illustrated in FIG. 1A, the conveyance roller pair 240 conveys the sheet P upward to the registration roller pair 250.

The feeding roller pair 210 includes an upper roller and a lower roller. The feeding roller pair 210 can adopt a feed and reverse roller (FRR) separation system or a friction roller (FR) separation system. The acronym "FRR" may refer to friction reverse roller.

In the feed and reverse roller (FRR) separation system, a separation roller (a return roller) is applied with a certain amount of torque in the direction counter to the sheet feeding direction via a torque limiter from a drive shaft and pressed against a feed roller to separate sheets in a nip between the separation roller and the feed roller. In the FR separation system, a separation roller (a friction roller) is supported by a secured shaft via a torque limiter and pressed against a feed roller to separate sheets in a nip between the separation roller and the feed roller.

The feeding roller pair 210 in the present embodiment employs the FRR separation system. That is, the feeding roller pair 210 includes a conveyance roller 220 and a separation roller 230. The conveyance roller 220 is an upper roller of the feeding roller pair 210 and conveys the sheet P into the body of the image forming apparatus 100. The separation roller 230 is the lower roller of the feeding roller pair 210. The separation roller 230 is given, by a drive shaft through a torque limiter, a driving force in the direction opposite the direction of driving force given to the conveyance roller 220.

The separation roller 230 is pressed against the conveyance roller 220 by a biasing member such as a spring. The driving force of the conveyance roller 220 is transmitted via a clutch to the pickup roller 60. Thus, the pickup roller 60 rotates counterclockwise in FIG. 1A.

The registration roller pair 250 feeds the sheet P, which has contacted the registration roller pair 250 and has the slackened leading end, toward a secondary transfer nip (a transfer nip N1 in FIG. 1B) between the secondary transfer roller 20 and the drive roller 18, at a suitable timing to transfer a toner image from the intermediate transfer belt 16 onto the sheet P. With the effect of a bias applied at the secondary transfer nip, the toner image is electrostatically transferred from the intermediate transfer belt 16 onto a designated position on the sheet P with a higher degree of accuracy.

Above the secondary transfer nip between the secondary transfer roller 20 and the drive roller 18, a post-transfer conveyance path 33 extends. A fixing device 300 is disposed near an upper end of the post-transfer conveyance path 33.

The fixing device 300 includes a fixing belt 310 as a fixing rotator, the heating device inside a loop of the fixing belt 310, and a pressure roller 320 as a pressure rotator that rotates while contacting the fixing belt 310 with a predetermined pressure. The fixing device 300 can be of any of various types.

A post-fixing conveyance path 35 extends above the fixing device 300 and branches into a sheet ejection path 36 and a reverse conveyance path 41 at the upper end of the post-fixing conveyance path 35. At the branching portion of the post-fixing conveyance path 35, a switching member 42 (such as a switching claw) is disposed and pivots on a pivot shaft 42*a*. At an opening end of the sheet ejection path 36, a sheet ejection roller pair 37 is disposed.

The reverse conveyance path 41 merges with the sheet feeding path 32 at the end opposite to the branching portion. Additionally, a reverse conveyance roller pair 43 is disposed midway in the reverse conveyance path 41. An upper face of the image forming apparatus 100 is recessed and forms as an output tray 44.

Between the transfer device 15 and the sheet feeder 200, a powder container 10 (for example, a toner container) is disposed. The powder container 10 is removably installed in the body of the image forming apparatus 100.

In the image forming apparatus 100 according to the present embodiment, for suitable sheet conveyance, a predetermined length is secured from the pickup roller 60 to the secondary transfer roller 20. The powder container 10 is disposed in a dead space caused by the predetermined length to keep the entire image forming apparatus 100 compact.

A transfer cover 8 is disposed above the sheet feeder 200 and on a front side in a direction to which the sheet feeder 200 is pulled out. The transfer cover 8 is opened to check an interior of the image forming apparatus 100. On the transfer cover 8, a bypass feed roller 45 for bypass sheet feeding and a bypass feeder 46 for the bypass sheet feeding are disposed.

Operation of Image Forming Apparatus

Next, a basic operation of the laser printer as an example of the image forming apparatus according to the present embodiment is described below with reference to FIG. 1A. First, operations of a simplex or single-sided printing are described.

Referring to FIG. 1A, the pickup roller 60 rotates according to a sheet feeding signal from a controller of the image forming apparatus 100. The pickup roller 60 separates the top sheet from a bundle of sheets P (also referred to as a sheet bundle) loaded in the sheet feeder 200 and feeds the uppermost sheet to the sheet feeding path 32.

When the leading end of the sheet P, which has been fed by the pickup roller 60 and the feeding roller pair 210, reaches a nip of the registration roller pair 250, the sheet P is slackened and temporarily stopped by the registration roller pair 250. The registration roller pair 250 corrects the skew on the leading end of the sheet P and rotates in synchronization with an optimum timing for transferring a toner image from the intermediate transfer belt 16 onto the sheet P.

In the case that the sheets P are fed from the bypass feeder 46, the bypass feed roller 45 feeds sheets P one by one from the top of the sheet bundle on the bypass feeder 46. Then, the sheet P passes a part of the reverse conveyance path 41 and is conveyed to the nip of the registration roller pair 250. Operations thereafter are similar to those of sheet feeding from the sheet feeder 200.

As to image formation, operations of the process unit 1K are described as representative, and descriptions of the other process units 1Y, 1M, and 1C are omitted here. First, the charging device 4K uniformly charges the surface of the image bearer 2K to high potential. The exposure device 7 irradiates the surface of the image bearer 2K with the laser light L according to image data.

The surface of the image bearer 2K irradiated with the laser light L has an electrostatic latent image due to a decrease in the potential of the irradiated portion. The developing device 5K includes a developer bearer 5*a* (illustrated in FIG. 1B) to bear developer including toner. The developing device 5K transfers, with the developer bearer 5*a*, unused black toner supplied from the toner bottle 6K onto the irradiated portion of the surface of the image bearer 2K having the electrostatic latent image.

The toner transferred to the image bearer 2K forms (develops) a black toner image on the surface of the image bearer 2K.

The black toner image formed on the image bearer 2K is transferred onto the intermediate transfer belt 16.

The photoconductor cleaner 3K removes, with a cleaning blade 3*a* (illustrated in FIG. 1B), residual toner remaining on the surface of the image bearer 2K after an intermediate transfer process. The removed residual toner is conveyed by a waste toner conveyor and collected to a waste toner container in the process unit 1K. The discharger discharges the remaining charge on the image bearer 2K after the remaining toner is removed by the photoconductor cleaner 3K.

In a similar manner, respective color toner images are formed on the image bearers 2Y, 2M, and 2C in the process units 1Y, 1M, and 1C, and the color toner images are transferred to the intermediate transfer belt 16 and superimposed on one on another thereon.

The intermediate transfer belt 16 travels to convey the color toner images superimposed thereon to the secondary transfer nip between the secondary transfer roller 20 and the drive roller 18. Meanwhile, the registration roller pair 250 rotates with the sheet P nipped therein at a predetermined timing, to convey the sheet P to the secondary transfer nip of the secondary transfer roller 20 such that a composite toner image formed by the superimposed toner images on the intermediate transfer belt 16 is transferred onto the sheet P. In this manner, the composite toner image on the intermediate transfer belt 16 is transferred to the sheet P sent out by the registration roller pair 250.

The sheet P having the transferred composite toner image is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300. The sheet P on which the composite toner image has been fixed is sent out from the fixing device 300 to the post-fixing conveyance path 35.

When the fixing device 300 sends out the sheet P, the switching member 42 is at a position indicated by the solid line in FIG. 1A so as to open the upper end of the post-fixing conveyance path 35. The sheet P sent out from the fixing device 300 is conveyed through the post-fixing conveyance path 35 to the sheet ejection path 36. The sheet ejection roller pair 37 nips the sheet P conveyed through the sheet ejection path 36 and rotates to eject the sheet P to the output tray 44. Thus, the single-sided printing is finished.

Next, duplex printing is described. Similar to the single-sided printing described above, the fixing device 300 sends out the sheet P to the sheet ejection path 36. In the duplex printing, the sheet ejection roller pair 37 rotates in a direction to convey a part of the sheet P outside the image forming apparatus 100.

When the trailing end of the sheet P exits the sheet ejection path 36, the switching member 42 pivots about a pivot shaft 42*a* as indicated by the broken line in FIG. 1A. Then, the upper end of the post-fixing conveyance path 35 is closed. Substantially simultaneously with closing of the upper end of the post-fixing conveyance path 35, the sheet ejection roller pair 37 rotates in the direction reverse to the direction to convey the sheet P outside the image forming apparatus 100. Thus, the sheet ejection roller pair 37 conveys the sheet P to the reverse conveyance path 41.

The sheet P sent out to the reverse conveyance path 41 reaches the registration roller pair 250 via the reverse conveyance roller pair 43. The registration roller pair 250 sends out the sheet P to the secondary transfer nip at a timing suitable for transferring the toner image from the intermediate transfer belt 16 onto the back side (to which no toner image has been transferred) of the sheet P.

When the sheet P passes through the secondary transfer nip, the secondary transfer roller 20 and the drive roller 18 transfer the toner image to the back side (to which no toner image has been transferred) of the sheet P. The sheet P having the transferred toner image is conveyed to the fixing device 300 through the post-transfer conveyance path 33.

In the fixing device 300, the sheet P is nipped by the fixing belt 310 and the pressure roller 320, and the unfixed toner image is fixed on the back side of the sheet P under heat and pressure. After the toner images are fixed to the front and back sides thereof in this manner, the sheet P is sent out from the fixing device 300 to the post-fixing conveyance path 35.

When the fixing device 300 sends out the sheet P, the switching member 42 is at a position indicated by the solid line in FIG. 1A so as to open the upper end of the post-fixing conveyance path 35. The sheet P sent out from the fixing device 300 is conveyed to the sheet ejection path 36 via the post-fixing conveyance path 35. The sheet ejection roller pair 37 nips the sheet P sent out to the sheet ejection path 36 and rotates to eject the sheet P to the output tray 44. Thus, the duplex printing is finished.

After the toner image on the intermediate transfer belt 16 is transferred onto the sheet P, residual toner remains on the intermediate transfer belt 16. The belt cleaner 21 removes the residual toner from the intermediate transfer belt 16. The toner removed from the intermediate transfer belt 16 is conveyed by the waste toner conveyor to the powder container 10 and collected in the powder container 10.

Sheet Feeder

Figure 4:
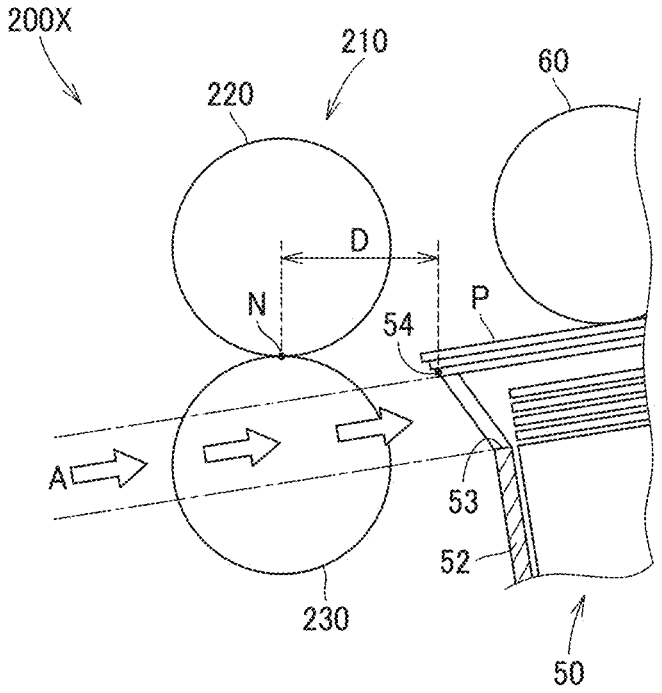
FIG. 4 is a schematic view of a sheet feeder according to a comparative example.

A description is given of a sheet feeder according to a comparative example, with reference to FIG. 4. A sheet feeder 200X illustrated in FIG. 4 includes the sheet feeding tray 50, the pickup roller 60, and the feeding roller pair 210 including the conveyance roller 220 and the separation roller 230. The sheet feeding tray 50 includes a front fence 52 for regulating a front end position of the bundle of sheets. At an upper end 54 of the front fence 52, cutouts 53 are provided for passing air A.

In the sheet feeder 200X illustrated in FIG. 4, the air A is applied to the front end of the sheet P from below the sheet conveyance path. For this reason, when several sheets P overlapped one another are conveyed beyond the upper end 54 of the front fence 52 toward a nip N of the feeding roller pair 210, the air A is not applied to the front end of the multi-fed sheets P. That is, in a range D from the upper end 54 of the front fence 52 to the nip N, the front end of the bundle of sheets P is not separated by the air A, and multifeed and jamming of the sheets P are not effectively prevented.

Figure 5A:
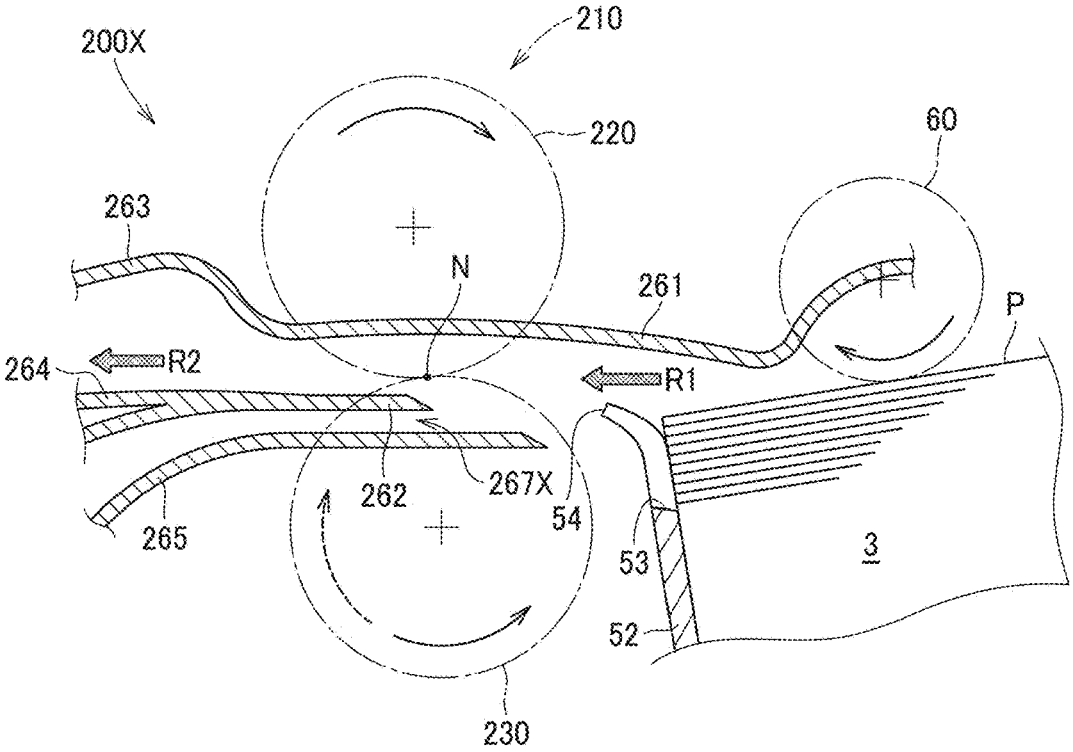
FIG. 5A is a schematic view of the sheet feeder according to the comparative example before air blowing.
Figure 5B:
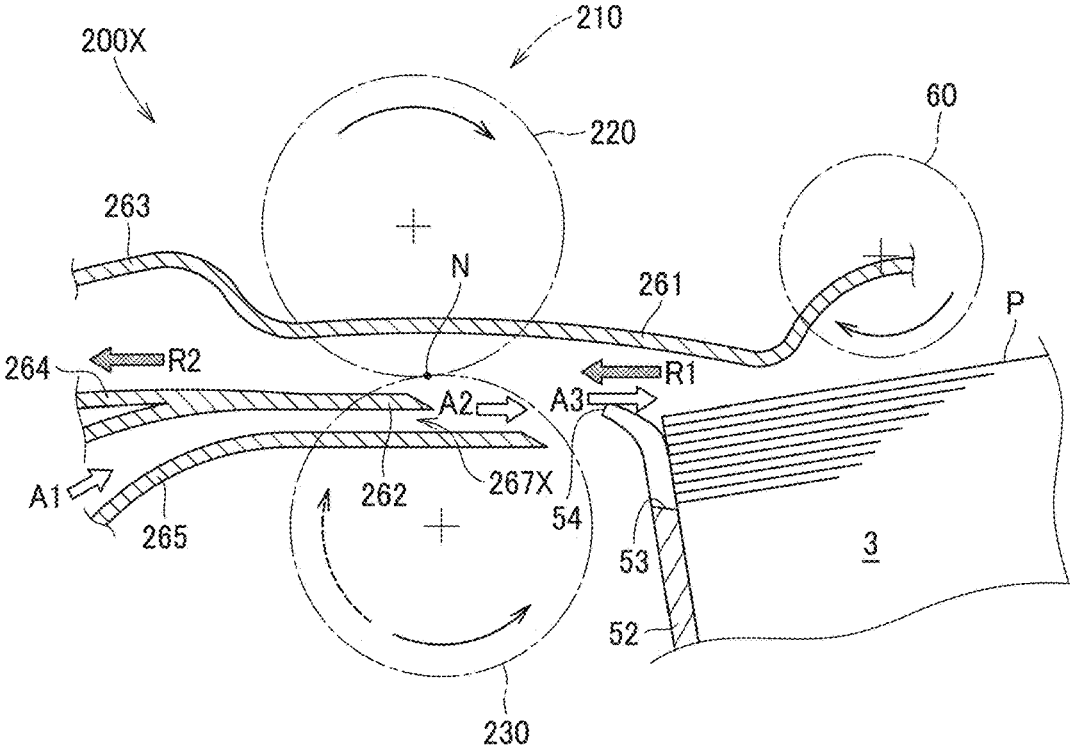
FIG. 5B is a schematic view of the sheet feeder according to the comparative example after air blowing.

The flow of air A and the sheet conveyance path in FIG. 4 are illustrated in more detail in FIG. 5A and FIG. 5B. In the sheet feeder 200X, the sheet P is conveyed through sheet feeding paths R1 and R2, and air from an air blowing port 267X causes airflow A1 to A3. FIG. 5A illustrates a state in which air is not blown out, and FIG. 5B illustrates a state in which air is blown out from the air blowing port 267X. Even if the air is blown out, the front end of the sheets P is not separated by the airflow A2 immediate upstream from the nip N, and multifeed and jamming of the sheet P are not effectively prevented.

There is a sheet feeder that includes a sheet feeding tray having a bottom plate inclined downward toward a front side (downstream in the sheet conveyance direction), such as a bypass sheet feeding tray or a document feeder. In such a sheet feeder, since the next sheet is easily fed in the inclined direction together with the previous sheet, the above-described multifeed and jam of the sheets easily occur.

By contrast, there is a sheet feeder including vertical two-stage air blowing ports (an upper air blowing port and a lower air blowing port), in order to enhance the effect of preventing multifeed. That is, first, several sheets in an uppermost layer of the sheet bundle are floated by the air from the lower air blowing port, and in this state, the top sheet of the uppermost layer is floated by the air from the upper air blowing port. In this manner, the upper layer of the sheet bundle is separated in two steps.

In a sheet feeder in which the vertical two-stage air blowing ports are disposed below the sheet conveyance path, when several sheets overlapped one another are conveyed beyond the upper end 54 of the front fence 52, the air is not applied to the front end of the overlapped sheets. Then, multifeed and jamming of the sheets P are not prevented.

Figure 2A:
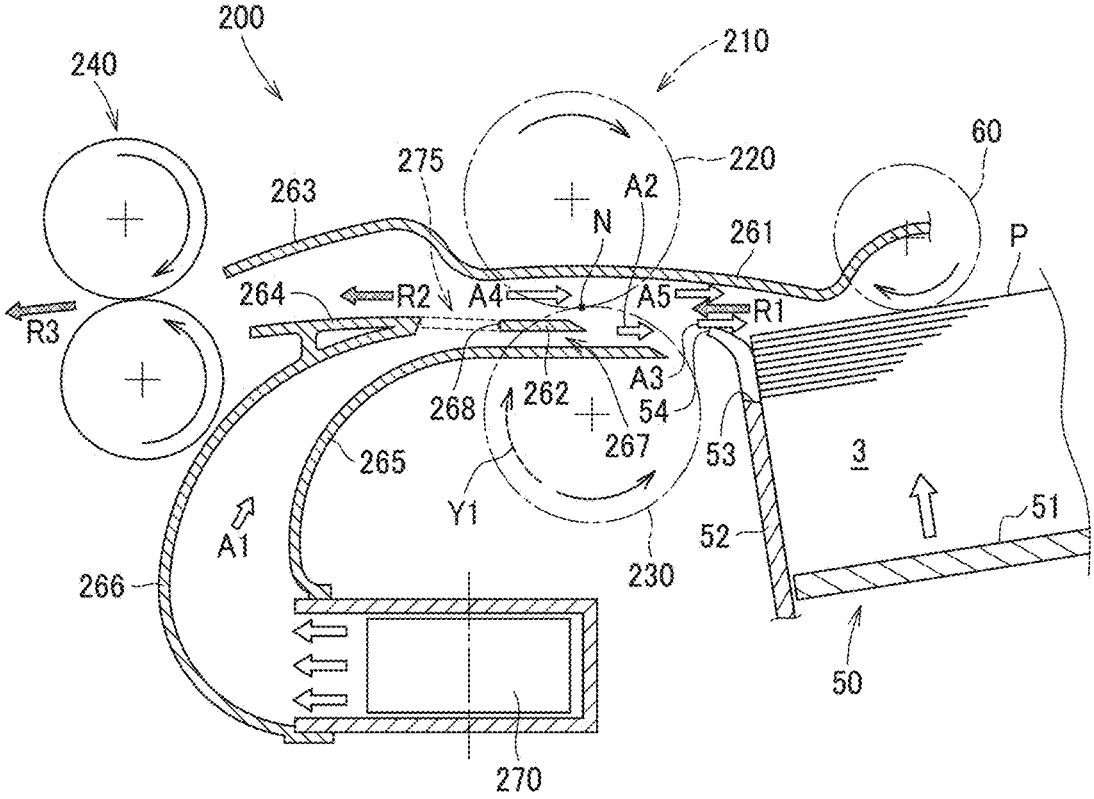
FIG. 2A is a schematic diagram illustrating a configuration of a sheet feeder according to one embodiment of the present disclosure.

A description is given of the sheet feeder 200 according to the present embodiment with reference to FIG. 2A. In the description below, "upstream" and "downstream" respectively refer to "upstream" and "downstream" in the sheet conveyance direction unless otherwise specified.

As illustrated in FIG. 2A, the sheet feeder 200 according to the present embodiment includes the sheet feeding tray 50 and the sheet feeding paths R1, R2, and R3 disposed downstream from the front fence 52 of the sheet feeding tray 50. The sheet feeding paths R1, R2, and R3 are parts of the sheet feeding path 32 illustrated in FIG. 1A. The sheet P is conveyed along the sheet feeding paths R1, R2, and R3.

The front fence 52 has a plurality of cutouts 53 in an upper end portion at different positions corresponding to first air blowing ports 267 described later. The airflow A3 from the first air blowing ports 267 reaches the front end of the stacked sheets P through the cutouts 53.

Upper covers 261 and 263 and lower covers 262 and 264 extend in a width direction (the direction perpendicular to the plane of FIG. 2A) of the sheet feeding paths R1, R2, and R3. The sheet feeding paths R1, R2, and R3 are disposed between the upper covers 261 and 263 and the lower covers 262 and 264. The sheets P are stacked on a liftable bottom plate 51 of the sheet feeding tray 50, and the sheets P in the uppermost layer of the bundle pushed up by the bottom plate 51 are sent out to the sheet feeding path R1 by the pickup roller 60.

The feeding roller pair 210 and the conveyance roller pair 240 disposed along the sheet feeding paths R1, R2, and R3 are of retard type and arranged in that order from the upstream side in the sheet conveyance direction. The feeding roller pair 210 includes the conveyance roller 220 and the separation roller 230. The separation roller 230 is in contact with the conveyance roller 220 via the nip N in a state in which torque is applied in the direction indicated by broken line arrow Y1.

The conveyance roller 220 and the separation roller 230 are driven to rotate in the clockwise direction while being in contact with each other at the nip part N, thereby preventing multifeed of the sheets P. When one sheet P is nipped in the nip N, the separation roller 230 rotates together with the conveyance roller 220.

The nip N is positioned between the sheet feeding paths R1 and R2. Further, the nip of the downstream conveyance roller pair 240 is positioned between the sheet feeding paths R2 and R3.

Air Blowing Port

The first air blowing ports 267 are disposed at an upstream end of the lower cover 262. Below the separation roller 230, a blower 270 is disposed. The first air blowing ports 267 communicate with the blower 270 via an air duct formed by side walls 265 and 266 bent in a U-shape.

The air blown out from the blower 270 is guided to the first air blowing ports 267 as the airflows A1 and A2.

Second air blowing ports 268 are disposed between the lower covers 262 and 264. The second air blowing ports 268 communicate with the blower 270 via the air duct shared with the first air blowing ports 267. The airflow A1 from the blower 270 is blown out from the second air blowing ports 268 as an airflow A4 and is blown out as an airflow A5 to an upstream portion of the sheet feeding path R1.

The upper cover 261 and the lower cover 262 function as a duct (air guide), thereby improving the effect of sheet separation by air. The air duct and the blower 270 are shared by the first air blowing ports 267 and the second air blowing ports 268. This is advantageous in easily arranging the air duct and the blower 270 at low cost even in a limited layout space in a sheet feeder. The first air blowing ports 267 and the second air blowing ports 268 are openable and closable by a shield 275 described later.

Figure 2B:
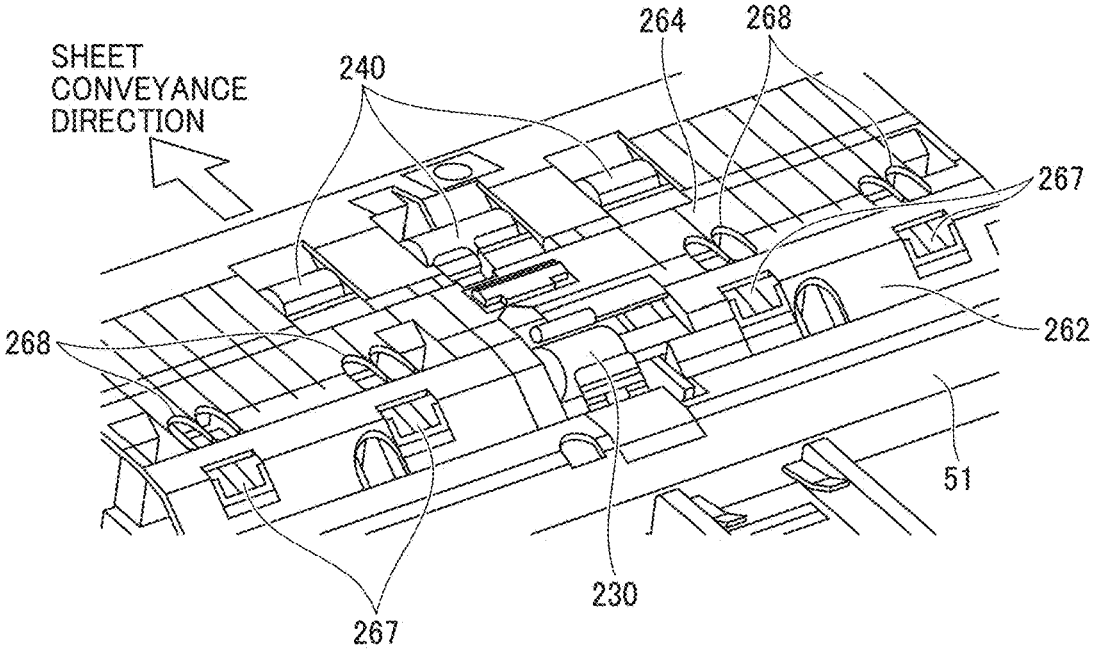
FIG. 2B is a perspective view from the top of the sheet feeder illustrated in FIG. 2A with an upper cover removed.
Figure 2C:
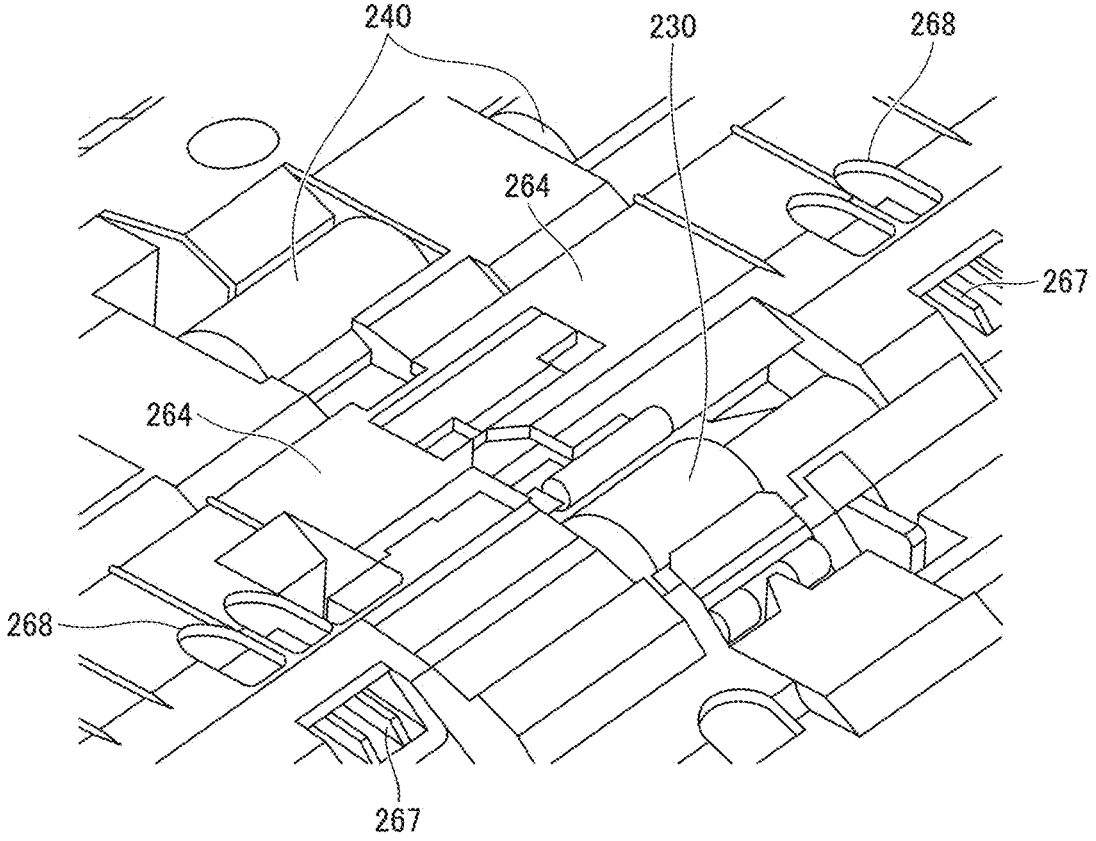
FIG. 2C is an enlarged perspective view of a main part of the sheet feeder illustrated in FIG. 2B.

As illustrated in FIGS. 2B and 2C in which the upper covers 261 and 263 are removed, two first air blowing ports 267 and two second air blowing ports 268 are provided on the lower covers 262 and 264, respectively, on both sides of the separation roller 230 in the width direction. Specifically, the separation roller 230 is disposed at the center in the width direction of the lower covers 262 and 264. The four first air blowing ports 267 and the four second air blowing ports 268 are disposed substantially symmetrically in the width direction with respect to the separation roller 230 and at substantially equal intervals. The sheet is conveyed in the direction indicated by an outlined arrow in the FIG. 2B.

Arranging the first air blowing ports 267 and the second air blowing ports 268 substantially equally on both sides of the separation roller 230 is advantageous in enhancing the effect of separating the multi-fed sheets P by air. That is, as the front end of the multi-fed sheets P approaches the nip N of the feeding roller pair 210, a space in the vertical direction in which the front end of the multi-fed sheet P can move becomes narrower. Accordingly, even if air is blown to a portion of the front end of the multi-fed sheets P close to the nip N in the width direction, the effect of separating the multi-fed sheets P by air is limited.

As illustrated in FIGS. 2B and 2C, when the first air blowing ports 267 and the second air blowing ports 268 are evenly arranged on both sides of the separation roller 230 at intervals, the blowing air can widely spread between the multi-fed sheets P. This structure enhances the effect of separating the multi-fed sheets P by air.

Shield

Figure 2D:
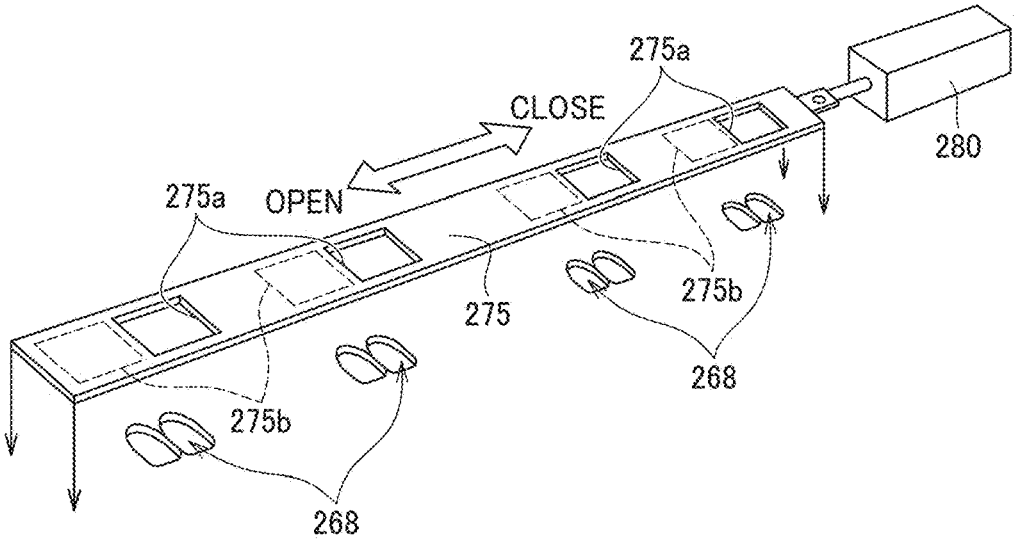
FIG. 2D is a perspective view of a shield for opening and closing second air blowing ports according to one embodiment of the present disclosure.

The second air blowing ports 268 described above can be opened and closed by the shield 275 illustrated in the FIG. 2D. For example, the shield 275 is horizontally long and plate-shaped. The shield 275 is disposed above the plurality of second air blowing ports 268 (the upper face of the lower cover 264) arranged in the width direction of the sheet conveyance path. The shield 275 is slidable in the direction indicated by double-head arrow in FIG. 2D (the width direction of the sheet conveyance path).

One end of the shield 275 is coupled to a solenoid 280 to drive the shield 275. By turning on and off the solenoid 280, the shield 275 can be opened and closed.

Specifically, the shield 275 has rectangular openings 275*a* corresponding to the positions of the second air blowing ports 268. Since the openings 275*a* match the second air blowing ports 268 in a state in which the solenoid 280 is off, air can be blown out from the second air blowing ports 268.

By contrast, when the solenoid 280 is turned on, the shield 275 slides to the right in the FIG. 2D, and closed portions 275*b* of the shield 275 match the second air blowing ports 268. Thus, the blowing of air from the second air blowing ports 268 is stopped.

In one embodiment, the first air blowing ports 267 are also provided with the shield 275 in a similar manner so that the first air blowing ports 267 can be opened and closed in the similar manner as the second air blowing ports 268. Although the shield 275 slides in FIG. 2D, alternatively, the shield 275 may rotate as illustrated in FIG. 3C.

When the shield is rotatable, the first air blowing ports 267 and the second air blowing ports 268 can be opened and closed by one shield. Further, by setting the shield to a neutral position, air can be blown out from both the first air blowing ports 267 and the second air blowing ports 268.

Effect of Sheet Separation by Air

Next, a description is given of experimental results of the effect of sheet separation by air by the first air blowing ports 267 and the second air blowing ports 268 with reference to FIGS. 3A to 3D. FIG. 3A-A illustrates an initial state, and no air is blown out from the first air blowing ports 267 and the second air blowing ports 268.

In this state, when the pickup roller 60 is driven to convey the sheet P to the sheet feeding path R1, there is a high possibility that a plurality of sheets P is densely (in a lump) multi-fed as illustrated in FIG. 3A-B.

FIG. 3B-A illustrates a case where the second air blowing ports 268 are closed by the shield 275 and air is blown out only from the first air blowing ports 267. In this case, as illustrated in FIG. 3B-B, about 10 sheets P from the bottom of the uppermost layer can be separated well, but the several sheets P from the bottom of the uppermost layer are not separated.

FIG. 3C-A illustrates a case where the first air blowing ports 267 are closed by the shield 275 and air is blown out only from the second air blowing ports 268, contrary to FIG. 3B-A. In this case, as illustrated in FIG. 3C-B, several sheets P (two to three sheets) from the top of the uppermost layer can be separated well, but the lower portion thereof is not separated well.

FIG. 3D-A illustrates a case where air is blown out from both the first air blowing ports 267 and the second air blowing ports 268. In this case, as illustrated in FIG. 3D-B, ten and several sheets of the upper layer sheets P are uniformly separated.

The possibility of multifeed of sheets P varies depending on the type of the sheets P. In general, multifeed of thin paper is more likely to occur than multifeed of thick paper. Therefore, the first air blowing ports 267 and the second air blowing ports 268 may be appropriately opened and closed in accordance with the type of the sheet P. For example, in the case of thin paper, preferably, only the second air blowing ports 268 are opened to blow out air as illustrated in FIG. 3C-A, both the first air blowing ports 267 and the second air blowing ports 268 are opened to blow out air as illustrated in FIG. 3D-A. In the case of thick paper, since multifeed is not likely to occur, blowing of air may be stopped as illustrated in FIG. 3A-A.

Further, at the initial stage of conveyance by the pickup roller 60, air may be blown only from the first air blowing ports 267 as illustrated in FIG. 3B-A. Then, when several sheets P of the uppermost layer not separated come close to the nip N of the feeding roller pair 210, air may be blown out only from the second air blowing ports 268. Separating the sheets P in two steps in this way can improves the sheet separation efficiency and enhance the sheet separation performance.

As described above, according to the present embodiment, air blowing ports are disposed at two positions along the sheet feeding paths R1 and R2. In other words, the sheet feeder 200 includes the first air blowing ports 267 (upstream air blowing ports) and the second air blowing ports 268 (downstream air blowing ports) disposed along the sheet conveyance direction. With this structure, air can be blown to the front end of the multi-fed sheets P until immediately before the front end of the multi-fed sheets P reaches the nip N of the feeding roller pair 210. As a result, the effect of sheet separation by air can be enhanced, and multifeed and jamming of sheets can be effectively prevented.

Although several embodiments of the present disclosure have been described above, embodiments of the present disclosure are not limited thereto, and a variety of modifications can be made within the scope of technical ideas of the present disclosure. Elements and/or features of different illustrative embodiments may be combined with each other and/or substituted for each other within the scope of the present invention.

For example, although the first air blowing ports 267 and the second air blowing ports 268 are provided in the above-described embodiment, three or more air blowing ports may be provided along the sheet conveyance path. For example, one or more third air blowing ports may be disposed between the first air blowing ports 267 and the nip N. It is needless to say that the third air blowing ports are separated from the nip N in the axial direction of the separation roller 230 (the width direction of the sheet conveyance path).

In the above-described embodiment, the first air blowing ports 267 and the second air blowing ports 268 are disposed upstream and downstream from the retard-type feeding roller pair 210 in the sheet conveyance direction. Alternatively, when a separation pad type conveyance roller and separation pad are used instead of the feeding roller pair 210, the first air blowing ports 267 and the second air blowing ports 268 may be disposed upstream and downstream from the conveyance roller and the separation pad.

The invention claimed is:

1. A sheet feeder comprising:

a separator configured to separate an uppermost layer from a bundle of sheets stacked on a sheet stacker;

a conveyor configured to convey a sheet of the uppermost layer one by one along a sheet conveyance path;

a first air blowing port disposed along the sheet conveyance path and configured to blow air upstream in a sheet conveyance direction; and a second air blowing port disposed along the sheet conveyance path and downstream from the first air blowing port, the second air blowing port being configured to blow air upstream in the sheet conveyance direction, wherein the conveyor includes a sheet feeding roller pair disposed along the sheet conveyance path, and wherein the first air blowing port is disposed upstream from the sheet feeding roller pair and the second air blowing port is disposed downstream from the sheet feeding roller pair.

2. The sheet feeder according to claim 1, wherein the sheet feeding roller pair is of retard type and includes a conveyance roller and a separation roller.

3. The sheet feeder according to claim 1, further comprising a shield configured to open and close the first air blowing port and the second air blowing port.

4. The sheet feeder according to claim 1, wherein the sheet feeding roller pair is disposed at a center in a width direction of the sheet conveyance path, wherein the first air blowing port includes a plurality of first air blowing ports disposed on both sides of the sheet feeding roller pair in the width direction, and wherein the second air blowing port includes a plurality of second air blowing ports disposed on the both sides of the sheet feeding roller pair in the width direction.

5. An image forming apparatus comprising:

the sheet feeder according to claim 1; and an image forming device configured to form an image on the sheet conveyed by the sheet feeder.

* * * * *